US006722621B2

(12) United States Patent
Johnson

(10) Patent No.: US 6,722,621 B2
(45) Date of Patent: Apr. 20, 2004

(54) ELECTRICAL BOX ASSEMBLY WITH REMOVABLE PROTECTIVE COVER

(75) Inventor: Steven J. Johnson, Galien, MI (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 10/188,057

(22) Filed: Jul. 3, 2002

(65) Prior Publication Data

US 2004/0004173 A1 Jan. 8, 2004

(51) Int. Cl.[7] ..... B42F 13/00; H01R 13/46

(52) U.S. Cl. ..... 248/343; 174/50; 174/58; 220/3.8; 220/242

(58) Field of Search ..... 248/343, 906; 220/242, 3.8, 3.3; 174/48, 50, 58, 60

(56) References Cited

U.S. PATENT DOCUMENTS

| | | | | | |
|---|---|---|---|---|---|
| 1,935,565 | A | | 11/1933 | Goetzelman | |
| 3,175,724 | A | | 3/1965 | Fiedler | |
| 4,044,908 | A | | 8/1977 | Dauberger | |
| 4,096,347 | A | * | 6/1978 | Penczak et al. | 174/48 |
| 4,343,411 | A | * | 8/1982 | Chesnut et al. | 220/242 |
| 5,234,119 | A | | 8/1993 | Jorgensen et al. | |
| 5,407,088 | A | | 4/1995 | Jorgensen et al. | |
| 5,522,577 | A | * | 6/1996 | Roesch | 248/343 |
| 5,562,222 | A | | 10/1996 | Jordan et al. | |
| 5,606,147 | A | * | 2/1997 | Deschamps et al. | 174/48 |
| 5,710,392 | A | * | 1/1998 | Bordwell et al. | 174/50 |
| 5,762,223 | A | | 6/1998 | Kerr, Jr. | |
| 5,902,960 | A | * | 5/1999 | Smith | 174/66 |
| 5,939,671 | A | * | 8/1999 | Gretz | 174/50 |
| 5,950,853 | A | | 9/1999 | Jorgensen | |
| 6,005,190 | A | * | 12/1999 | Stark et al. | 174/66 |
| 6,107,568 | A | | 8/2000 | Schnell et al. | |
| 6,126,028 | A | * | 10/2000 | Buckley | 220/3.8 |
| 6,355,883 | B1 | * | 3/2002 | Gretz | 174/58 |
| 6,421,904 | B1 | * | 7/2002 | Wedekind et al. | 29/432 |
| 6,450,353 | B1 | * | 9/2002 | Riedy et al. | 220/3.3 |
| 6,509,524 | B1 | * | 1/2003 | Gretz | 174/50 |
| 6,646,201 | B1 | * | 11/2003 | Gretz | 174/58 |

FOREIGN PATENT DOCUMENTS

| | | |
|---|---|---|
| CA | 2137987 | 6/1995 |

OTHER PUBLICATIONS

Arlington Industries Advertisement for Fan/Fixture Box FB 440; at least as early as Jan. 2002.

* cited by examiner

*Primary Examiner*—Anita King
(74) *Attorney, Agent, or Firm*—Alfred N. Goodman; Marcus R. Mickney; Mark S. Bicks

(57) ABSTRACT

An assembly that receives an electrical fixture and secures the electrical fixture to a support. The assembly has an electrical box for attaching to the support. A cover is connected to the electrical box to prevent access to the electrical box. A portion of the cover is removable to provide access to the electrical box. A first opening in the electrical box receives a first fastener for securing the electrical box to the support. A second opening in the electrical box receives a second fastener for securing the electrical fixture to the electrical box.

32 Claims, 7 Drawing Sheets

ELECTRICAL BOX ASSEMBLY WITH REMOVABLE PROTECTIVE COVER

FIELD OF THE INVENTION

The present invention relates to an electrical box assembly. More particularly, the present invention relates to an electrical box having a cover to prevent access thereto until a portion of the cover is removed. More particularly, the present invention relates to an electrical box having at least one cavity for receiving wiring, a cover to prevent access to the at least one cavity, and a portion of the cover that is removable to access the at least one cavity. Once the removable portion of the cover has been removed, an electrical fixture may be mechanically and electrically connected to the electrical box.

BACKGROUND OF THE INVENTION

Electrical boxes are attached to supports prior to installing the surrounding surface or ceiling. Many electrical boxes are adapted to be attached to a ceiling joist, truss or other framing member. Once the electrical box is secured to the framing member, the surrounding ceiling is formed, which is generally made of drywall or plaster, and then painted. An electrical fixture, such as a ceiling fan or luminary fixture, is then attached to the electrical box.

Wiring is run to the electrical box prior to the formation of the ceiling and housed within the electrical box. Typically, electrical boxes used to support electrical fixtures are no larger in diameter then that portion protruding through the finished ceiling surface. This constraint restricts the wiring capacity of the box, as well as making access to the wires in the box difficult for the electrician. Existing electrical boxes generally do not have covers to protect wiring and fasteners housed within or connected to the electrical boxes during the formation and finishing of the ceiling, which includes painting of the ceiling. A separate cover must be found and attached to the electrical box to protect the wiring from plaster, paint and other debris associated with forming and painting the ceiling around the electrical box. Once the ceiling is finished, the cover must be removed to access the wiring housed therein. The cover is then discarded. If the electrical box is not covered during the formation and finishing of the ceiling, the wiring housed within the electrical box may be damaged or covered in paint or other debris, thereby preventing a good electrical connection between the wiring and the electrical fixture and making identification of the color of the wires difficult. For electrical boxes rated for use with ceiling fans, fasteners are generally supplied with the electrical boxes for securing the ceiling fan. Such fasteners are typically sent loose in the packaging and are prone to being lost before the ceiling fan is mounted.

Thus, there is a continuing need to provide improved electrical box assemblies.

SUMMARY OF THE INVENTION

Accordingly, it is a primary object of the invention to provide an electrical box assembly having a cover to prevent access thereto until a portion of the cover has been removed.

Another object of the invention is to provide a cover for an electrical box assembly that is easily attached to protect wiring housed within.

Another object of the invention is to provide a cover for an electrical assembly having portions that are easily removed to access wiring housed within the electrical box once the ceiling has been formed and painted.

Still another object of the invention is to provide posts on the removable portions of the cover for retaining electrical fixture fasteners.

The foregoing objects are basically attained by providing an assembly for receiving an electrical fixture comprising an electrical box for attaching to a support; a cover connected to the electrical box to prevent access to the electrical box; a portion of the cover being removable to provide access to the electrical box; a first opening in the electrical box for receiving a first fastener for securing the electrical box to the support; and a second opening in said electrical box for receiving a second fastener for securing the electrical fixture to the electrical box.

The foregoing objects are also attained by providing a method of installing an electrical fixture, comprising the steps of attaching an electrical box having a cavity to a support; covering the electrical box with a cover having a removable portion to prevent access to the cavity of the electrical box; forming a ceiling around the support; removing the removable portion of the cover to access the cavity of the electrical box; and attaching an electrical fixture to the electrical box.

Other objects, advantages and salient features of the invention will become apparent from the following detailed description, which, taken in conjunction with the annexed drawings, discloses a preferred embodiment of the invention.

BRIEF DESCRIPTION OF THE DRAWINGS

Referring now to the drawings that form a part of the original disclosure.

DETAILED DESCRIPTION OF THE INVENTION

Figure 1:
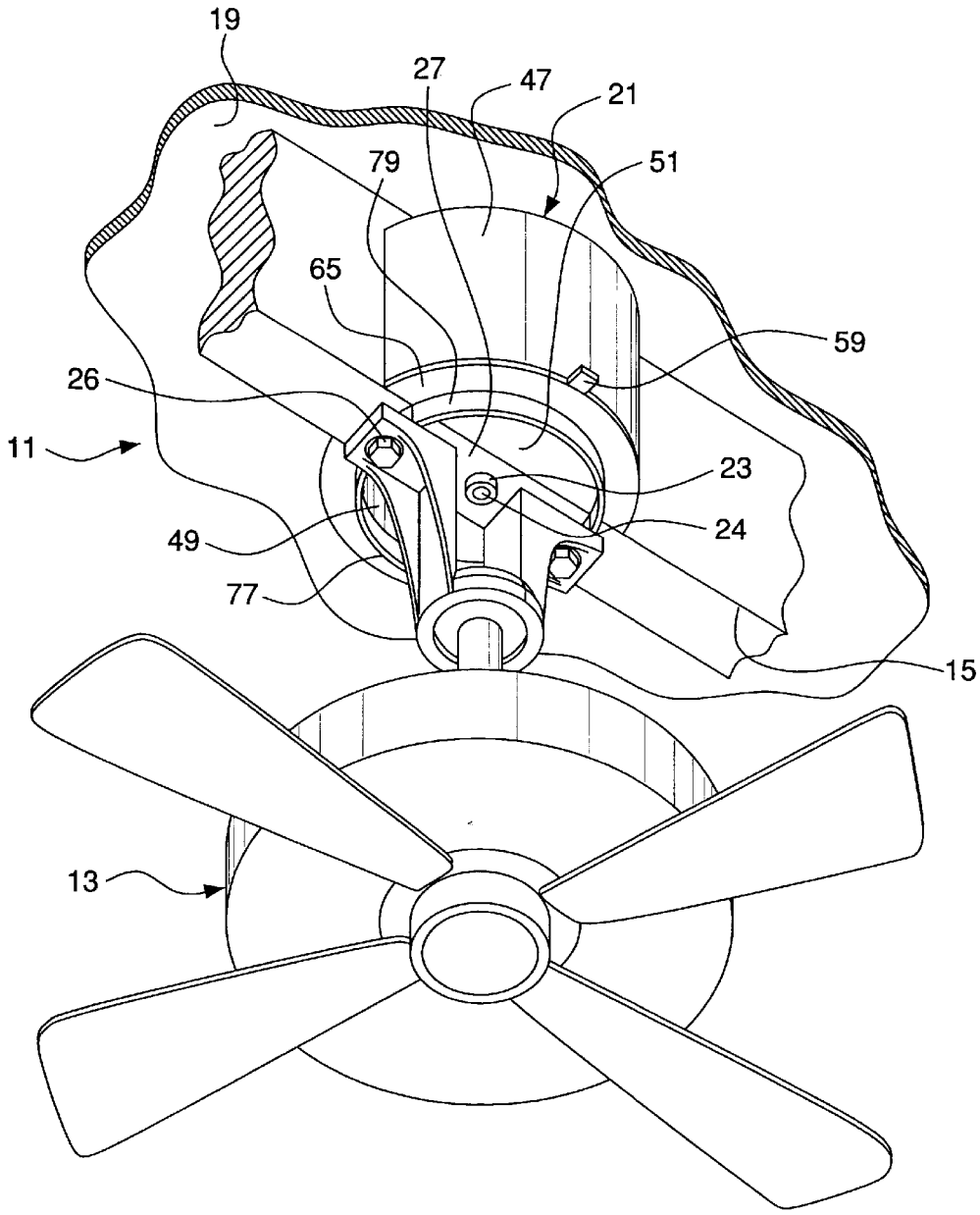
FIG. 1 is a perspective view of an electrical box assembly in accordance with a first embodiment of the invention with the electrical box assembly attached to a support and an electrical fixture secured to the electrical box assembly.

As seen in FIGS. 1–7, an assembly 11 for receiving an electrical fixture 13 has an electrical box 21 for attaching to a support 15, a cover 61 connected to the electrical box to prevent access to the electrical box, a removable portion 71 of the cover to provide access to the electrical box, a first opening 23 in the electrical box for receiving a first fastener 24 for securing the electrical box to the support, and a second opening 25 in the electrical box for receiving a second fastener 26 for securing the electrical fixture to, or through, the electrical box. The cover 61 protects wiring 17 housed within the electrical box assembly 11 during the formation and painting of the ceiling 19. The removable portion 71 of cover 61 is removed after ceiling 19 is formed and painted to allow access to wiring 17 housed within the electrical box assembly 11 and to mechanically and electrically connect electrical fixture 13.

Figure 2:
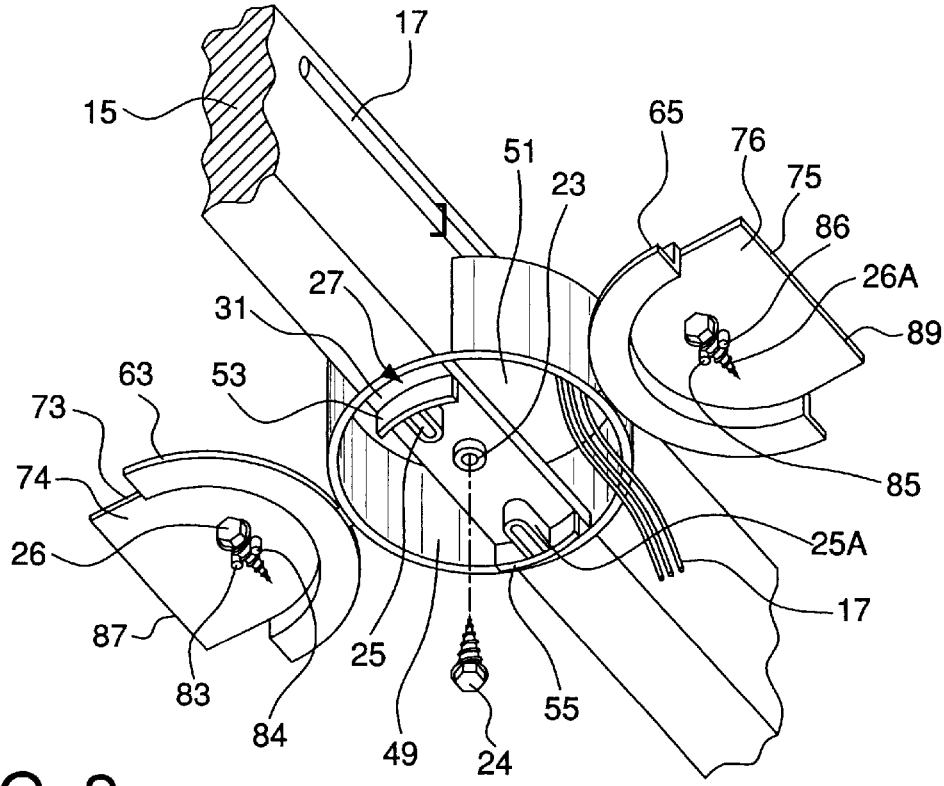
FIG. 2 is a perspective view of the electrical box assembly of FIG. 1 attached to a support and with an open cover.
Figure 5:
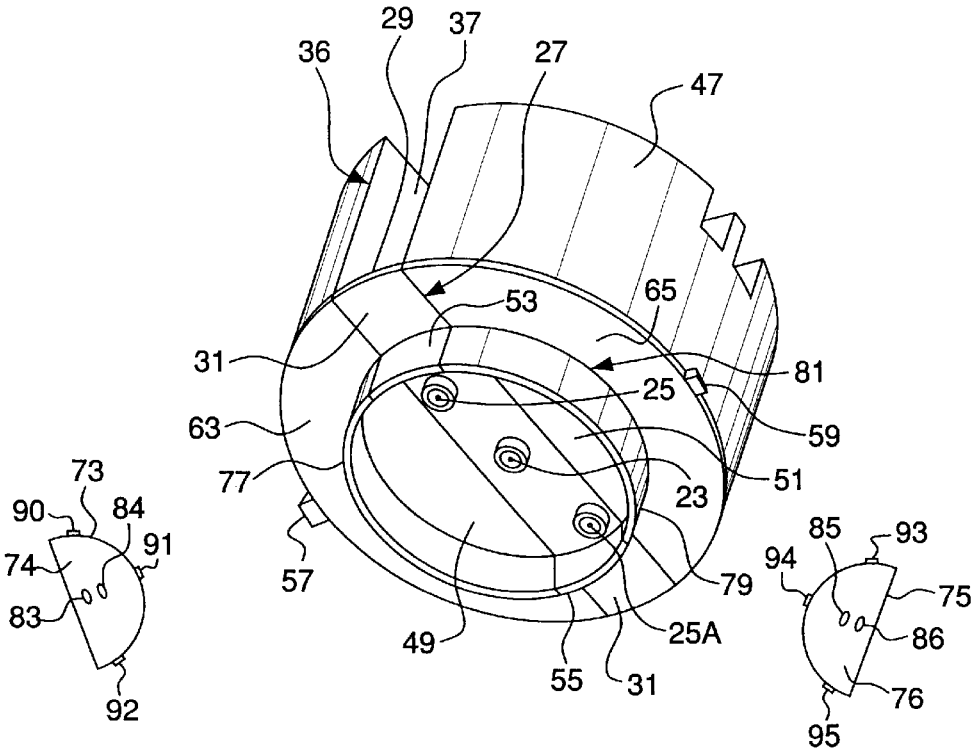
FIG. 5 is a perspective view of the electrical box assembly of FIG. 3 in which the cover has been closed and the removable portions of the cover removed.
Figure 6:
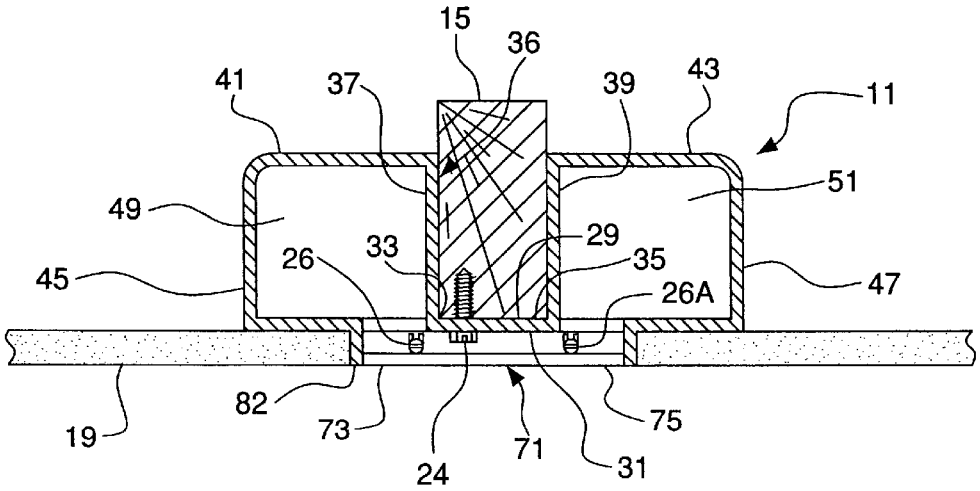
FIG. 6 is a cross sectional view in side elevation of the electrical box assembly of FIG. 4 prior to installation of the electrical fixture and removal of the covers.
Figure 7:
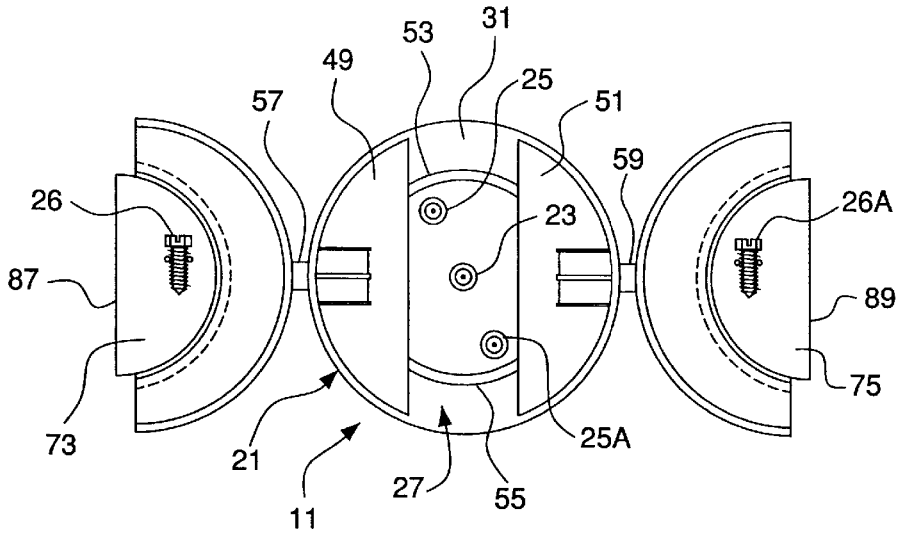
FIG. 7 is a bottom plan view of the electrical box assembly of FIG. 5 with the cover open and not removed.

The electrical box 21 has a base 27 that has an upper surface 29 and a lower surface 31, as shown in FIGS. 2, 5 and 6. The upper surface 29 of the base has a first edge 33 and a second edge 35. A first inner wall 37 extends substantially perpendicularly from the first edge 33 and a second inner wall 39 extends substantially perpendicularly from the second edge 35, such that the first and second inner walls are substantially parallel. A ceiling joist 15 is received within the U-shaped area 36 formed by the base 27, first inner wall 37 and second inner wall 39. First and second upper walls 41 and 43, respectively, extend substantially perpendicularly in opposite directions from the first and second inner walls. Preferably, first and second upper walls 41 and 43 form substantially semi-circular upper surfaces. First and second outer walls 45 and 47 extend substantially perpendicularly from the first and second upper walls, respectively, toward the base of the electrical box. A first cavity 49 is defined by the first inner wall 37, first upper wall 41 and first outer wall 45. A second cavity 51 is defined by the second inner wall 39, second upper wall 43 and second outer wall 47. Preferably, first and second cavities 49 and 51 are substantially crescent shaped or D-shaped, as shown in FIGS. 2 and 7. Although described as having first and second cavities, the electrical box assembly may have only one cavity.

Figure 4:
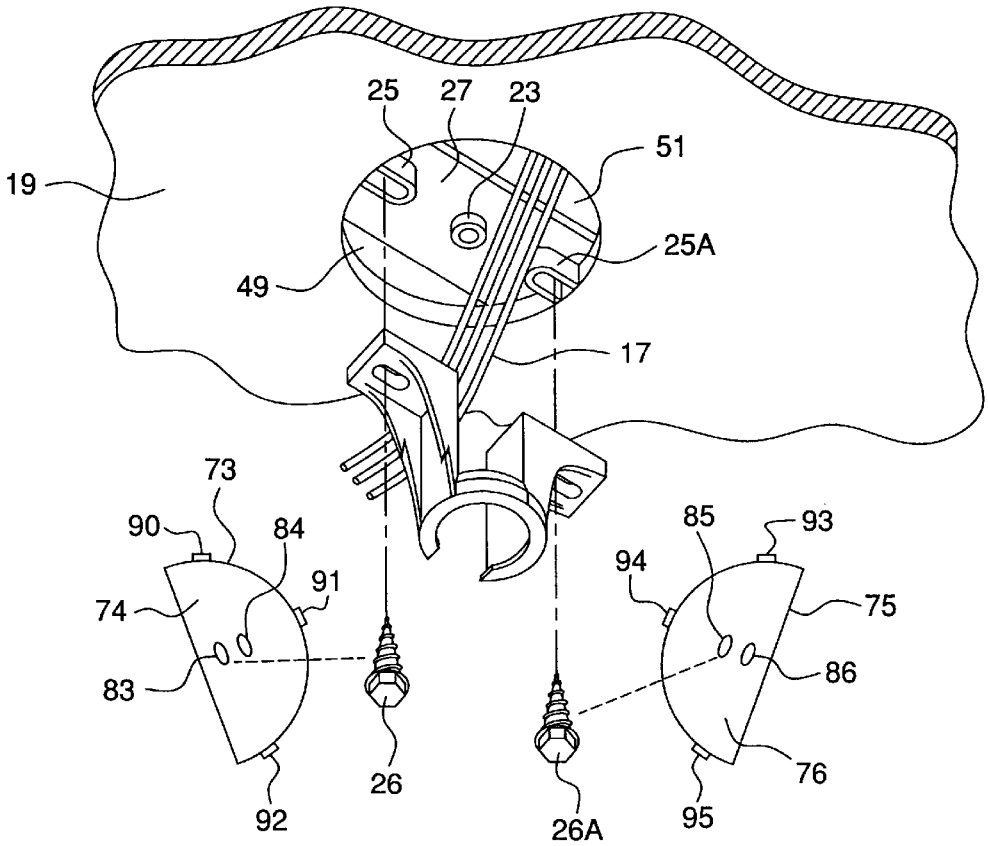
FIG. 4 is a perspective view of the electrical box assembly of FIG. 3 around which a ceiling has been formed and painted, the removable portions of the cover have been removed, and an electrical fixture is about to be secured to the electrical box assembly.

A first opening 23 in base 27 receives a first fastener 24 for securing the electrical box 21 to a support 15, preferably a ceiling joist as shown in FIG. 1. A second opening 25 receives a second fastener 26 for securing an electrical fixture 13 to the electrical box 21, as shown in FIGS. 1 and 4. Preferably, there are two second openings 25 and 25A for receiving second fasteners 26 and 26A to secure the electrical fixture to the electrical box 21. Preferably, the second fasteners 26 and 26A extend through electrical box 21 into support 15 to firmly secure the electrical fixture to the support. Preferably, the electrical fixture 13 is a ceiling fan or luminary fixture.

A first rim tab 53 extends substantially perpendicularly downwardly from the lower surface 31 of base 27. A second rim tab 55 extends substantially perpendicularly downwardly from the lower surface 31 of base 27. Preferably, second rim tab 55 is diametrically opposed to first rim tab 53.

Figure 3:
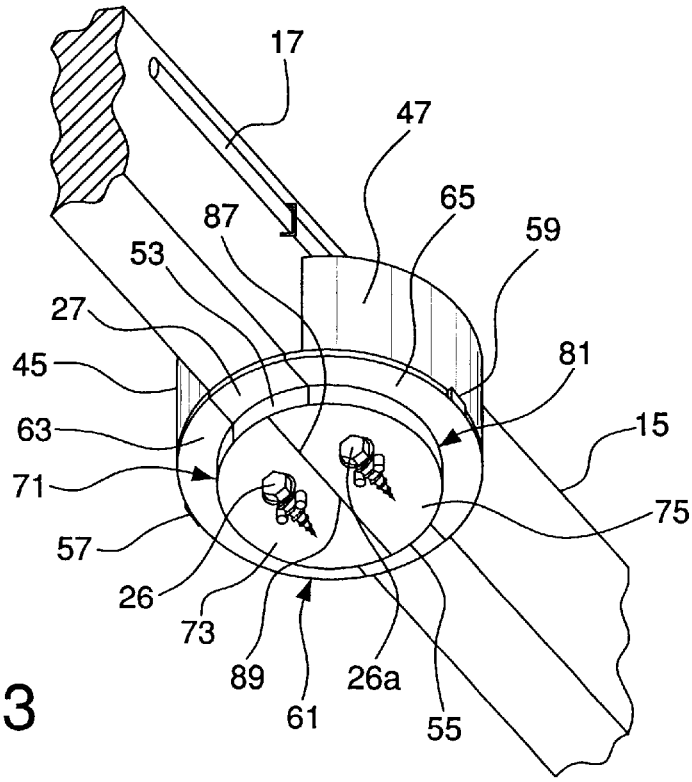
FIG. 3 is a perspective view of the electrical box assembly of FIG. 2 attached to a support and with the cover closed.

A cover 61, as shown in FIG. 3, prevents access to first and second cavities 49 and 51 (FIG. 2) when closed over the electrical box 21. A removable portion 71 of cover 61 is removed once the ceiling has been formed and finished, including painting, to provide access to first and second cavities 49 and 51 in the electrical box 21. Preferably, the cover 61 has a first portion 63 and a second portion 65, as shown in FIG. 2, that are non-removable. Preferably, the first and second cover portions 63 and 65 are each attached with a hinge 57 and 59 to the electrical box. Preferably, hinges 57 and 59 are integrally molded with the electrical box, i.e., they are "living" hinges. The first and second cover portions 63 and 65 are then attached with a snap fit as shown, or by any other suitable means, such as with a fastener.

A first rim 77 extends substantially perpendicularly downwardly from the first cover portion 63. A second rim 79 extends substantially perpendicularly downwardly from the second cover portion 65. When the cover 61, including attached removable portion 71, is closed over the electrical box 21, a rim 81 is created by the alignment of the first and second rims 77 and 79 and the first and second rim tabs 53 and 55.

The first portion 63 of cover 61 has a first removable portion 73. The second portion 65 of cover 61 has a second removable portion 75. The first and second removable portions 73 and 75 are attached to the first and second cover portions, respectively, in any suitable manner that allows the first and second removable portions to be removed quickly and easily. As shown in FIGS. 4 and 5, the first removable portion 73 is connected to the first cover portion 63 by tabs 90, 91 and 92. Second removable portion 75 is connected to the second cover portion 65 by tabs 93, 94 and 95. Preferably, the first removable portion 73 extends inwardly from the first rim 77 and the second removable portion 75 extends inwardly from the second rim 79.

First mounting posts 83 and 84 are attached to an inner surface 74 of first removable portion 73. Second mounting posts 85 and 86 are attached to an inner surface 76 of second removable portion 75. The first and second mounting posts 83–84 and 85–86 receive second fasteners 26 and 26A, respectively.

Assembly and Disassembly

Prior to forming a ceiling, the electrical box assembly 11 is connected to a support 15, such as the ceiling joist shown in FIG. 2. The U-shaped area 36 defined by first inner wall 37, base 27 and second inner wall 39 snugly receives ceiling joist 15. Preferably, the width of the U-shaped area 36 is sized to provide an interference fit with the ceiling joist. This eliminates an installer from having to keep one hand on the electrical box assembly to hold it in place against the joist during installation. The installer is free to use both hands to secure the electrical box assembly to the joist. First opening 23 in base 27 receives first fastener 24 to secure electrical box 21 to joist 15. Electrical wires 17 are then run into the electrical box from above. Preferably, first and second cavities 49 and 51 are large to facilitate easy access to wiring 17 and to provide a large wiring capacity.

As shown in FIG. 3, the first and second cover portions 63 and 65 are closed over the electrical box 21. First and second cover portions 63 and 65 are rotated about hinges 57 and 59, respectively, and then snap fit in a closed position on the electrical box. First and second cover portions 63 and 65 are flush with the ends of base 27 upon closing the cover portions. Rim 81 is formed upon closing the first and second cover portions. First and second removable portions 73 and 75 mate along their respective inner edges 87 and 89, as shown in FIG. 3, to completely seal the first and second cavities in the electrical box, thereby protecting the first and second cavities and its contents from damage and collection of miscellaneous debris associated with forming and finishing a ceiling. Wiring 17 is housed within the first and second cavities of the electrical box during the ceiling forming and finishing process, thereby being protected within cavities 49 and 51 by cover 61.

Ceiling 19 is then formed around the electrical box assembly 11. The ceiling is formed flush with lower end 82 of rim 81, as shown in FIG. 6. Cover 61 and rim 81 allow for a smaller opening through the ceiling for accessing the electrical box 21. Once the ceiling has been formed and finished, the removable portion 71 of cover 61 is removed to access the wiring housed in cavities 49 and 51. As shown in FIGS. 4 and 6, the removable portion 71 includes first and second removable portions 73 and 75. The removable portions are easily detached from first and second cover portions 63 and 65 by breaking the six connecting tabs 90–95 used to connect the removable portions to the non-removable cover portions. Alternatively, any suitable means may be used to connect the removable portions of the cover to the non-removable portions, including, but not limited to, any number of tabs, a score line, or a perforation.

Second fasteners 26 and 26A are conveniently retained on the inner surfaces 74 and 76 of first and second removable portions 73 and 75 by mounting posts 83–84 and 85–86, respectively. By mounting second fasteners on the inner surface of the removable portion of the cover, the second fasteners are also prevented from being damaged during the ceiling forming and finishing process. Moreover, the installer does not have to hunt to find fasteners to install the electrical fixture as the second fasteners are conveniently mounted to the removable portion of the cover. Once the first and second removable portions have been detached (FIG. 4), the second fasteners are received by second openings 25 and 25A to secure the electrical fixture 13 to the electrical box 21, as shown in FIGS. 1 and 4.

Figure 8:
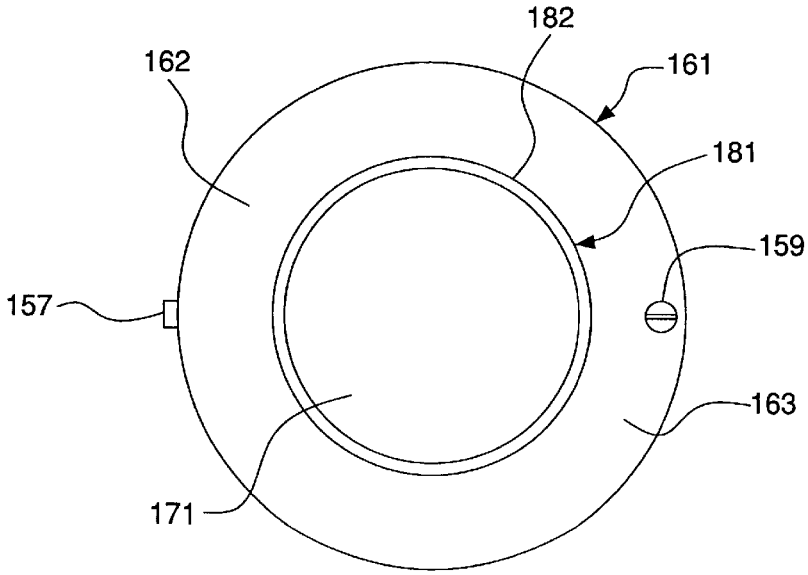
FIG. 8 is a bottom plan view of a second embodiment of the electrical box assembly having one non-removable annular outer portion and one removable circular inner portion.

Embodiment of FIG. 8

A second embodiment of the invention is shown in FIG. 8. The cover 161 has a non-removable annular outer portion 162 and a removable circular inner portion 171. A circular rim 181 extends substantially perpendicularly outwardly from the outer surface 163 of the non-removable portion of the cover. The removable portion 171 of the cover is bounded by an outer edge 182 of rim 181, as shown in FIG. 6 with regard to the first embodiment. A hinge 157, preferably a living hinge, secures the cover 161 to the electrical box. A cover fastener 159 diametrically opposed to hinge 157 secures the cover 161 to the electrical box when closed. Alternatively, a snap fit may be used to secure cover 161 to the electrical box when closed.

The remaining features of the second embodiment are identical to those of the first embodiment.

Embodiment of FIGS. 9–13

A third embodiment of the invention is shown in FIGS. 9–13. An assembly 211 for receiving an electrical fixture has an electrical box 221 for attaching to a support 215, a cover 261 connected to the electrical box to prevent access to the electrical box, a removable portion 271 of the cover to provide access to the electrical box, a first opening 223 in the electrical box for receiving a first fastener 224 for securing the electrical box to the support, and a second opening 225 in the electrical box for receiving a second fastener 279 for securing the electrical fixture to the electrical box. The cover 261 protects wiring housed within the electrical box assembly 211 during the formation and painting of the ceiling 219. The removable portion 271 of the cover is removed after ceiling 219 is formed and finished to access wiring housed within the electrical box assembly and to mechanically and electrically connect an electrical fixture.

Figure 10:
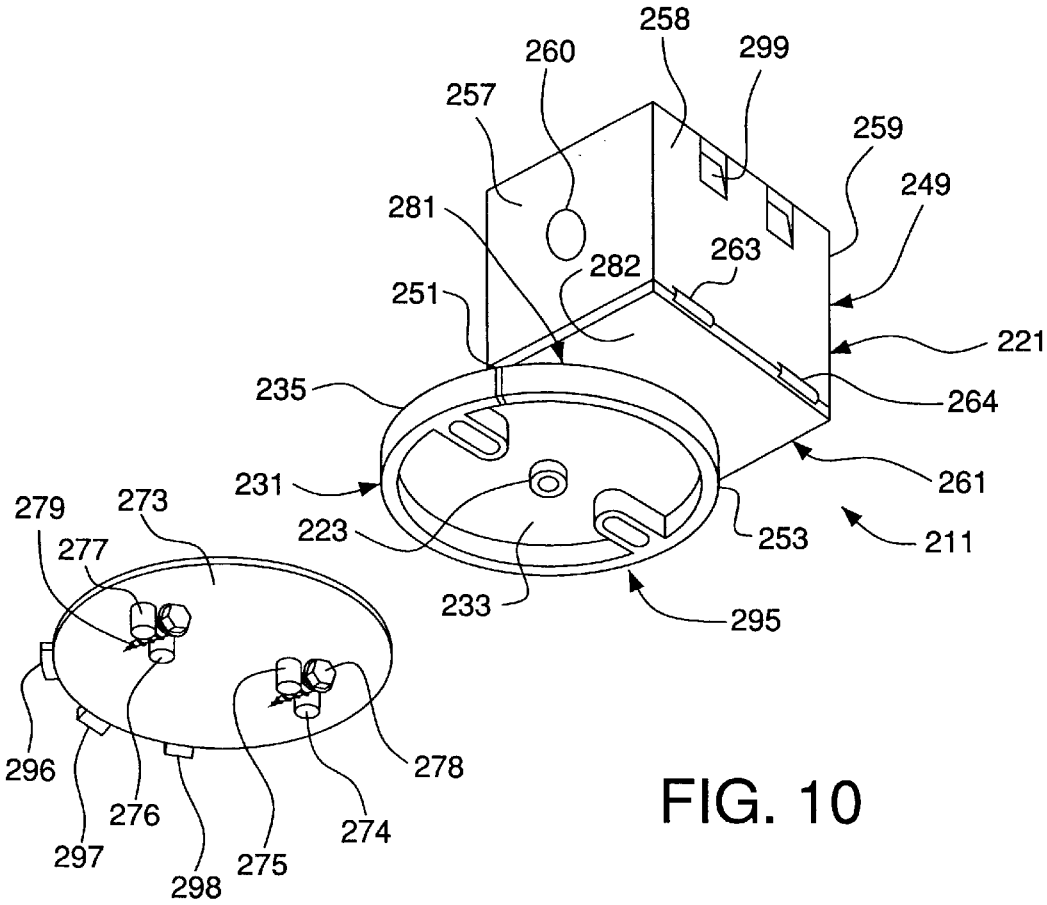
FIG. 10 is a perspective view of the electrical box assembly of FIG. 9 with the removable portion of the cover detached.
Figure 11:
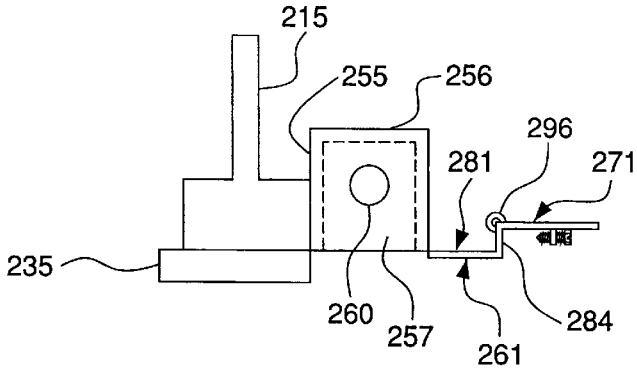
FIG. 11 is a elevational view of the electrical box assembly of FIG. 9 attached to a joist and with the cover open.
Figure 12:
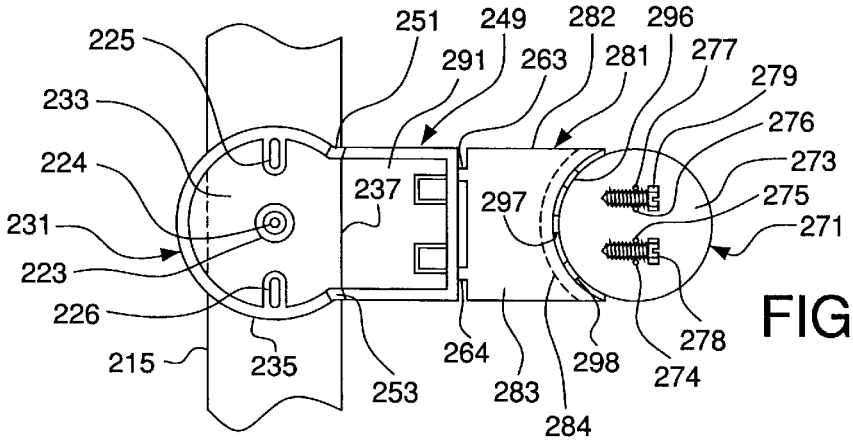
FIG. 12 is a bottom plan view of the electrical box assembly of FIG. 11.
Figure 13:
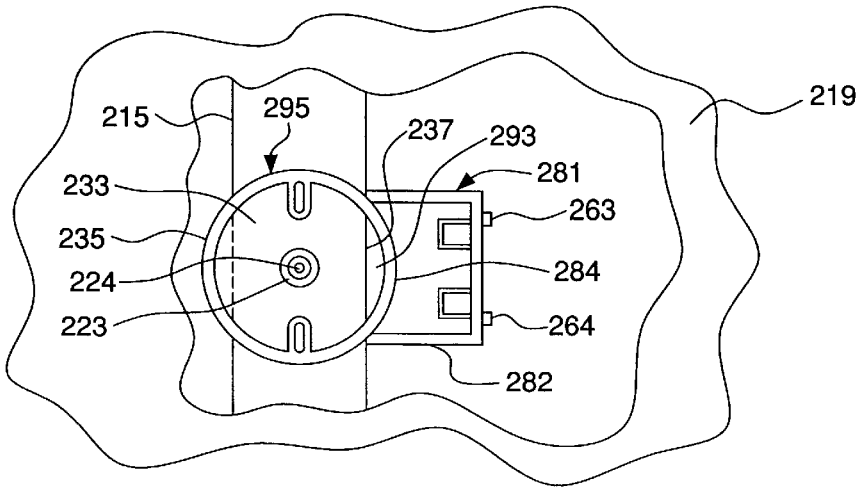
FIG. 13 is a bottom plan view of the electrical box assembly of FIG. 10 with the cover closed and the removable portion detached.

As shown in FIGS. 9–13, the electrical box 221 includes a base 231 and a cavity 249. The base 231 has a surface 233 from which a wall 235 extends substantially perpendicularly. The wall extends from a first corner 251 of cavity 249 counter-clockwise to a second corner 253 of the cavity. The first opening 223 receives a first fastener 224 for securing the electrical box to the support 215, as shown in FIGS. 12–13. Second openings 225 and 226 receive second fasteners 278 and 279 for securing an electrical fixture to the electrical box 221.

Figure 9:
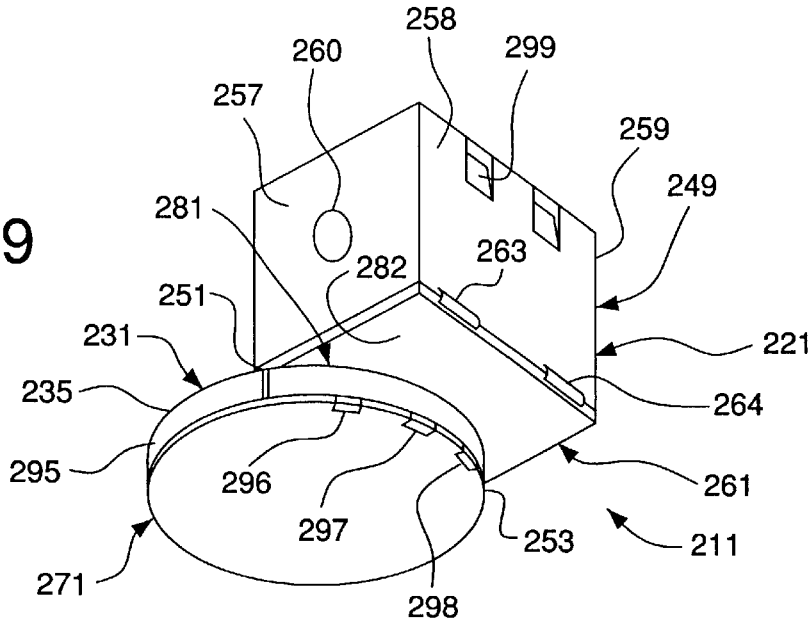
FIG. 9 is a perspective view of an electrical box assembly according to a third embodiment of the present invention with the cover closed over the electrical box.

The cover 261 has a removable portion 271 and a non-removable portion 281, as shown in FIGS. 9–13. Hinges 263 and 264 connect the cover 261 to the electrical box 221. Preferably, the hinges 263 and 264 are living hinges, such that the cavity 249, hinges and base 231 are formed integrally. As shown in FIGS. 9 and 11, the removable portion 271 is connected to the non-removable portion by tabs 296, 297 and 298 for easy separation. Alternatively, the removable portion is connected to the non-removable portion in any manner suitable for easy separation of the removable portion from the non-removable portion, including, but not limited to, a weakened section, a scored section, a perforated section, or by any number of tabs.

As shown in FIGS. 9 and 10, the removable portion 271 of the cover 261 is preferably circular in shape. A pair of first mounting posts 274 and 275 and second mounting posts 276 and 277 extend from an inner surface 273 of the removable portion 271 of the cover 261 to secure second fasteners 278 and 279 to the cover during formation and finishing of a ceiling.

As shown in FIGS. 9 and 10, the non-removable portion 281 of the cover 261 has a base 282 for covering the cavity 249. A wall 284 extends substantially perpendicularly from an inner surface 283 of the base 282. When the cover is closed over the electrical box, the wall 284 extends from the first corner 251 to the second corner 253 of the electrical box in a clockwise direction, thereby forming a complete circle when mated with the wall 235 of the base 231.

As shown in FIG. 12, edge 237 connects first and second corners 251 and 253 of the electrical box 221. A first cavity wall 255 extends substantially perpendicularly upwardly from edge 237. An upper cavity wall 256 extends substantially perpendicularly outwardly from an upper end of the first cavity wall 255. Preferably, the upper cavity wall is a square or rectangle. Second, third and fourth cavity walls 257, 258 and 259, respectively, extend substantially perpendicularly downwardly from the three remaining edges of the upper cavity wall to form the cavity 249. Preferably, the cavity 249 is cube-shaped to provide a large wire holding area for wire management. A knockout 260 and/or clamp 299 may be provided in any cavity wall to provide access to the cavity for wiring.

As shown in FIGS. 11–13, first fastener 244 is inserted through first opening 223 in the base 231 to secure the electrical box assembly 211 to the support 215. The first cavity wall 255 is positioned adjacent the support 215. Electrical wires are then run to the cavity 249 through knockout 260 or clamp 299.

As shown in FIGS. 9 and 10, the cover 261 is then closed over opening 291 of cavity 249 and the base 231 to protect wiring housed within the cavity during formation and finishing of the ceiling 219. The cover 261 is secured to the electrical box in any suitable manner, such as by a snap fit. The cover wall 284 mates with the base wall 235 to form a circular wall 295. The removable portion 271 covers the circular wall 295.

As shown in FIG. 10, the removable portion 271 of the cover 261 is detached from the non-removable portion 281 to provide access to the cavity 249 once the ceiling has been formed and finished. Area 293 within the circular wall 295 provides access to the cavity 249 once the removable portion 271 of the cover 261 has been removed. Second fasteners 278 and 279 are removed from mounting posts 274 and 275 and 276 and 277, respectively, prior to discarding the removable portion 271 of the cover 261. The second fasteners are then used to secure an electrical fixture to the base 231 of the electrical box 221.

While an advantageous embodiment has been chosen to illustrate the invention, it will be understood by those skilled in the art that various changes and modifications may be made therein without departing from the scope of the invention as defined in the appended claims.

What is claimed is:

1. An assembly for receiving an electrical fixture, comprising:

an electrical box for attaching to a support;

a cover connected to said electrical box to prevent access to said electrical box;

a portion of said cover being removable to provide access to said electrical box;

a first opening in said electrical box for receiving a first fastener for securing said electrical box to the support; and a second opening in said electrical box for receiving a second fastener for securing the electrical fixture to said electrical box.

2. The assembly according to claim 1, wherein said cover is integrally molded with said electrical box.

3. The assembly according to claim 1, wherein a hinge pivotally connects said cover to said electrical box.

4. The assembly according to claim 3, wherein said cover is secured to said electrical box with a third fastener.

5. The assembly according to claim 3, wherein said cover is secured in place over said electrical box with a snap-fit.

6. The assembly according to claim 1, wherein said cover is secured in place over said electrical box with a snap fit.

7. The assembly according to claim 1, wherein said second fastener is releasably secured to said removable portion of said cover.

8. The assembly according to claim 1, wherein retaining posts releasably secure said second fastener to said removable portion of said cover.

9. The assembly according to claim 1, wherein said cover has a first non-removable portion and a second non-removable portion and said removable portion has a first removable portion and a second removable portion, said first removable portion being connected to said first non-removable cover portion and said second removable portion being connected to said second non-removable cover portion.

10. The assembly according to claim 9, wherein said first and second non-removable cover portions are integrally molded with said electrical box.

11. The assembly according to claim 9, wherein a hinge pivotally connects each of said first and second non-removable cover portions to said electrical box.

12. The assembly according to claim 11, wherein each of said first and second non-removable cover portions is secured to said electrical box with a fourth fastener.

13. The assembly according to claim 11, wherein each of said first and second non-removable cover portions is secured in place over said electrical box with a snap-fit.

14. The assembly according to claim 11, wherein said cover is secured in place over said electrical box with a snap fit.

15. An assembly for receiving an electrical fixture, comprising:

an electrical box for attaching to a support and having at least one cavity for receiving wiring;

a cover connected to said electrical box to prevent access to said at least one cavity, a portion of said cover being removable to provide access to said at least one cavity;

a first opening in said electrical box for receiving a first fastener for securing said electrical box to the support; and a second opening in said electrical box for receiving a second fastener for securing the electrical fixture to said electrical box.

16. The assembly according to claim 15, wherein said cover is integrally molded with said electrical box.

17. The assembly according to claim 15, wherein a hinge pivotally connects said cover to said electrical box.

18. The assembly according to claim 17, wherein said cover is secured to said electrical box with a third fastener.

19. The assembly according to claim 17, wherein said cover is secured in place over said electrical box with a snap-fit.

20. The assembly according to claim 15, wherein said cover is secured in place over said electrical box with a snap fit.

21. The assembly according to claim 15, wherein said second fastener is releasably secured to said removable portion of said cover.

22. The assembly according to claim 15, wherein retaining posts releasably secure said second fastener to said removable portion of said cover.

23. An assembly for securing an electrical fixture to a support, comprising:

an electrical box for attaching to a support and having first and second cavities for receiving wiring;

first and second covers connected to said electrical box proximal said first and second cavities to prevent access to said first and second cavities, respectively, said first and second covers having first and second portions, respectively;

first and second portions of said first and second covers being removable for accessing said first and second cavities;

a first opening in said electrical box for receiving a first fastener for securing said electrical box to the support; and a plurality of second openings in said electrical box for receiving second fasteners for securing the electrical fixture to said electrical box.

24. The assembly according to claim 23, wherein said first and second covers are integrally molded with said electrical box.

25. The assembly according to claim 23, wherein a hinge pivotally connects each of said first and second covers to said electrical box.

26. The assembly according to claim 23, wherein each of said first and second covers is secured to said electrical box with a third fastener.

27. The assembly according to claim 23, wherein each of said first and second covers is secured in place over said electrical box with a snap-fit.

28. The assembly according to claim 23, wherein each of said first and second covers is secured in place over said electrical box with a snap fit.

29. The assembly according to claim 23, wherein at least one of said second fasteners is releasably secured to each of said first and second removable portions.

30. The assembly according to claim 23, wherein retaining posts releasably secure said second fasteners to said first and second removable portions.

31. A method of installing an electrical fixture, comprising the steps of:

attaching an electrical box having a cavity to a support;

sealing the electrical box with a cover having a removable portion to prevent access to the cavity of the electrical box;

forming a ceiling around the support;

detaching the removable portion of the cover without removing the support to access the cavity of the electrical box; and attaching an electrical fixture to the electrical box.

32. The method of installing an electrical fixture of claim 31, further comprising removing a fastener releasably secured to the removable portion of the cover; and wherein attaching an electrical fixture to the electrical box comprises attaching an electrical fixture to the electrical box with the fastener releasably secured to the removable portion of the cover.

* * * * *